United States Patent [19]

Hoover et al.

[11] Patent Number: 4,801,902

[45] **Date of Patent: * Jan. 31, 1989**

[54] WAVEGUIDE CIRCULATOR WITH I/O PORT IMPEDANCE MATCHING PRODUCED BY FERRITE-PORT GAP DIMENSIONING

[75] Inventors: John C. Hoover, Roswell; David E. Giese, Duluth, both of Ga.

[73] Assignee: Electromagnetic Sciences, Inc., Norcross, Ga.

[ * ] Notice: The portion of the term of this patent subsequent to Sep. 29, 2004 has been disclaimed.

[21] Appl. No.: 103,782

[22] Filed: Sep. 28, 1987

Related U.S. Application Data

[63] Continuation-in-part of Ser. No. 852,146, Apr. 15, 1986, Pat. No. 4,697,158.

[51] Int. Cl.[4] ..... H01P 1/39

[52] U.S. Cl. ..... 333/1.1; 333/33

[58] Field of Search ..... 333/1.1

[56] References Cited

U.S. PATENT DOCUMENTS

| | | | |
|---|---|---|---|
| 3,038,131 | 6/1962 | Uebele et al. . | |
| 3,080,536 | 3/1963 | Dewhirst . | |
| 3,188,582 | 6/1965 | Bowness . | |
| 3,231,835 | 1/1966 | Nielsen et al. . | |
| 3,311,849 | 3/1967 | Bosma | 333/1.1 |
| 3,334,317 | 8/1967 | Andre . | |
| 3,341,789 | 9/1967 | Goodman et al. . | |
| 3,355,679 | 11/1967 | Carr . | |
| 3,492,601 | 1/1970 | Omori . | |
| 3,534,276 | 10/1970 | Berteaud et al. . | |
| 4,058,780 | 11/1977 | Riblet . | |
| 4,496,915 | 1/1985 | Mathew et al. . | |
| 4,697,158 | 9/1987 | Hoover et al. | 333/1.1 |

OTHER PUBLICATIONS

"Broadband Latching Switches and Circulators'-'—Research and Development Technical Report ECOm-02445-4 by J. W. Simon et al dated Mar. 1968, pp. 1-51 Abstract and Table of Contents.

"The Compact Turnstile Circulator"—IEEE Transactions on Microwave Theory and Techniques, vol. MTT-18, No. 12, Dec. 1970 by Brian Owen and Clare E. Barnes, pp. 1096-1100.

"The Identification of Modal Resonances in Ferrite Loaded Waveguide Y-Junctions and Their Adjustment for Circulation"—The Bell System Technical Journal, Mar. 1972, pp. 505-627.

*Primary Examiner*—Paul Gensler

*Attorney, Agent, or Firm*—Nixon & Vanderhye

[57] ABSTRACT

Impedance matching between a waveguide circulator and its input/output ports is achieved by properly dimensioning a gap formed between a ferrite circulator element inside the waveguide circulator and at least a portion of the input/output port aperture itself. Typically, the I/O port aperture has at least a portion which is of lesser height dimension than the internal waveguide circulator cavity. Ridge waveguide or ridge-to-rectangular waveguide adaptor blocks, or the like, may emanate from such input/output circulator apertures.

14 Claims, 1 Drawing Sheet

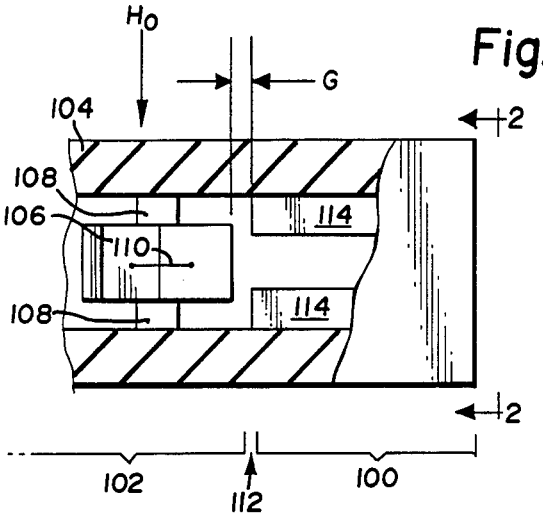
Fig. 1
Fig. 2
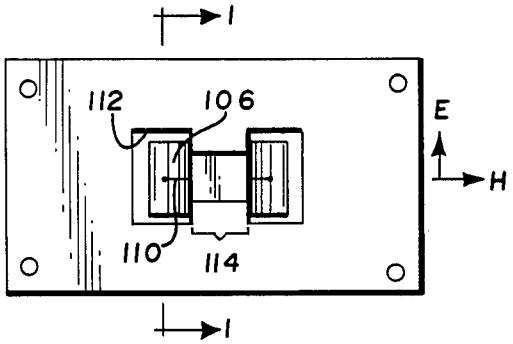
Fig. 3
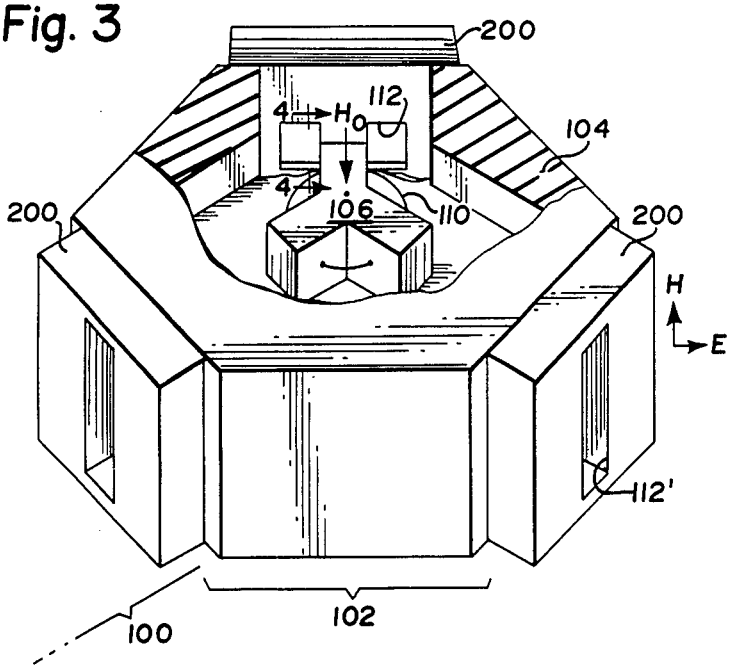
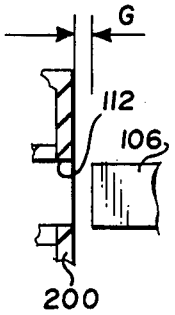
Fig. 4

WAVEGUIDE CIRCULATOR WITH I/O PORT IMPEDANCE MATCHING PRODUCED BY FERRITE-PORT GAP DIMENSIONING

This application is a continuation-in-part of our earlier, copending commonly assigned U.S. application Ser. No. 852,146 filed Apr. 15, 1986 (now U.S. Pat. No. 4,697,158). The entire content of such earlier allowed application is hereby incorporated herein by reference.

This application is also related to earlier commonly assigned U.S. Pat. No. 4,673,946 and the entire content of this patent also is hereby expressly incorporated herein by reference.

This invention is generally related to microwave waveguide circulator devices having ferrite circulator elements which are capable of coupling microwave energy to/from a pair of adjacent input/output ports while isolating a third input/output port.

The circulator phenomenon has been known and utilized for many years. For a general discussion, the earlier referenced related patents (and references cited therein) may be consulted.

In our earlier parent application, we described an exemplary embodiment wherein approximate impedance matching between the circulator cavity and an input/output port is achieved by properly dimensioning a gap between the ferrite circulator element and a reduced height input/output port. In earlier exemplary embodiments, the input/output port comprised the entrance to a rectangular waveguide.

The present application describes further exemplary embodiments of the same invention which similarly achieve approximate impedance matching via such a specially dimensioned gap but where the reduced height input/output port may constitute only a portion of that port—as in a direct coupled ridge waveguide. Improved compactness may result from using direct coupled ridge waveguide for at least two adjacent input/output ports of the circulator.

Similar ridge waveguide input/output circulator ports may be associated with a ridge-to-rectangular waveguide adaptor as described in commonly assigned U.S. Pat. No. 4,673,946. And the same adaptor may be used to provide rectangular-to-rectangular waveguide changes in angular orientation. Such composite embodiments may be used to provide a composite waveguide circulator apparatus having, in effect, an E-plane waveguide orientation (even where a latching ferrite toroid is used with a latch wire loop that must be maintained perpendicular to the E-field.

These as well as further objects and advantages of this invention will be more completely appreciated by reading the following detailed description of such further embodiments in conjunction with the accompanying drawings, of which:

FIG. 1 is a schematic partial cross-sectional view of a waveguide circulator having an impedance-matching gap G with direct coupled ridge waveguide;

FIG. 2 is an end view through the ridge waveguide input/output port of the embodiment shown in FIG. 1;

FIG. 3 is a schematic partially cut-away view of a further embodiment also having ridge waveguide like input/output ports but incorporation ridge-to-rectangular waveguide adaptors therewith; and FIG. 4 is a schematic cross-sectional view of a portion of FIG. 3 illustrating the impedance-matching gap.

FIGS. 1 and 2 schematically depict the direct coupling of a section of ridge waveguide 100 to a waveguide circulator cavity 102. As is typical, the walls 104 of the circulator and of the waveguide are formed from conductive material. A suitable ferrite circulator element 106 (e.g., typically having three legs extending therefrom at 120° intervals) is centrally located within the cavity 106 by suitable spacers 108 or the like. If the circulator is of the latching variety, then a latch switching wire 110 is typically threaded through the legs of the ferrite circulator element 106 along a plane which is perpendicular to the E-field. Accordingly, the input/output ports (e.g., apertures situated about the periphery of circulator cavity 102 opposite legs of ferrite element 106) typically have an H-plane orientation as will be appreciated by those in the art. As will also be appreciated, a permanent magnet or the like may also be used to bias the ferrite element 106 with a suitable magnetic field $H_O$ so as to yield conventional waveguide circulator functions.

The familiar H or I shaped ridge waveguide cross-section is apparent in the FIG. 2 depiction of the input/output port aperture 112. As can be seen, such a traditional ridge waveguide cross-section provides an input/output port 112 having a reduced height section 114 which, together with the periphery of the ferrite element 106, defines a gap G (see FIGURE 1) which may be used to achieve approximate impedance matching between the circulator cavity 102 and the input/output waveguide 100—in exactly the same fashion as already explained in detail in our earlier copending parent application (now U.S. Pat. No. 4,697,158).

Although only one input/output port 112 is depicted in detail in FIGS. 1 and 2, it will be appreciated that any number (including all) of the input/output ports to such a conventional circulator cavity could be directly coupled to ridge waveguide with a properly dimensioned gap G so as to produce approximate impedance matching via that input/output port.

In effect, the direct coupled ridge waveguide in FIGS. 1 and 2 uses the identical impedance matching algorithm as the reduced height rectangular waveguide used in our earlier exemplary embodiments. However, in the ridge waveguide embodiment some or all of the reduced height may be achieved simply by the normal cross-sectional aperture of the ridge waveguide itself. It will also be appreciated by those in the art that the maximum height of the ridge waveguide could be somewhat reduced with respect to the height of the circulator cavity. As in our earlier embodiments, first order impedance matching is achieved by proper dimensioning of gap G between the periphery of ferrite toroid 106 and the beginning of the ridge waveguide. As with our earlier embodiments, other conventional fine tuning impedance matching elements may also be desired depending upon the impedance level of the ridge waveguide and the desired frequency band(s) of operation.

As previously mentioned, such ridge waveguide may be used on one or all ports of the circulator. However, there is a potential advantage in providing at least two input/output ports with ridge waveguide. For example, the greater mode separation of ridge waveguide may permit closer spacing of such two input/output junctions of the circulator so as to result, overall, in increased compactness.

As depicted in the embodiment of FIGS. 1 and 2, a latching ferrite circulator typically provides an H-plane orientation of the input/output ports (i.e., the E-field is typically perpendicular to the "height" of the circulator device and its input/output ports). In general, for latching ferrite toroids, this orientation is required because the latching wire path must be maintained perpendicular to the E-field.

However, by utilizing the ridge-to-rectangular waveguide adaptors of commonly assigned U.S. Pat. No. 4,673,946, one may effectively obtain an E-plane orientation of a composite circulator apparatus as depicted in FIGS. 3 and 4. Here, the input/output port apertures 112 are still of the ridge waveguide cross-sectional shape (and thus still capable of defining an impedance matching gap G with the periphery of the ferrite element 106 at a reduced-height section of aperture 112) However, as explained in U.S. Pat. No. 4,673,946, the ridge-to-rectangular waveguide adaptors 200 effectively rotate the E and H fields so as to provide an E-plane orientation at the port 112' on the outer side of adaptors 200 (to which conventional E-plane rectangular waveguide may be connected). As will be appreciated by those in the art, the rotated port 112' could also be a ridge waveguide aperture if desired. Indeed, if desired, the inner (and/or outer) ports of adaptors 200 could be of rectangular waveguide shape (albeit the inner port must be at least partly of reduced height with respect to the circulator cavity so as to properly define the impedance matching gap G).

Although only a few further exemplary embodiments have been described in detail above, those skilled in the art will recognize that many modifications and variations may be made in the exemplary embodiments while yet retaining many of the novel features and advantages of this invention. Accordingly, all such modifications and variations are intended to be included within the scope of the appended claims.

What is claimed is:

1. A waveguide circulator comprising:

a conductive waveguide structure having a cavity located therewithin of a first predetermined height, said cavity having plural input/output apertures emanating therefrom, at least one of said apertures having at least a portion thereof which is of a second, lesser predetermined height;

a ferrite circulator element disposed within said central cavity and having an outer extremity spaced from an inner edge of said second predetermined height by a gap G having a predetermined gap dimension which achieves an approximate impedance match between the impedance of the ferrite element and the impedance associated with said aperture; and means for creating a magnetic field within said ferrite element and causing it to act as a circulator element.

2. A waveguide circulator as in claim 1 wherein said at least one aperture conforms to an H-shaped cross section of ridge waveguide.

3. A waveguide circulator as in claim 2 further comprising a length of ridge waveguide coupled to said at least one aperture.

4. A waveguide circulator as in claim 3 wherein a length of ridge waveguide is coupled to at least two adjacent ones of said apertures.

5. A waveguide circulator as in claim 2 further comprising:

a ridge-to-rectangular waveguide adaptor having a a ridge waveguide input/output port coupled to said at least one aperture and having an output/input port on an opposite side with an E-field orientation disposed at an angle to the E-field orientation of said at least one aperture.

6. A waveguide circulator as in claim 4 wherein said angle is approximately 90°.

7. A waveguide circulator as in claim 4 wherein said output/input port also has a ridge wavegude cross section.

8. A waveguide circulator as in claim 4 wherein said output/input port has a rectangular waveguide cross section.

9. A waveguide circulator comprising:

a ferrite circulator element including means for creating a magnetic field therein;

a conductive circulator cavity of a first predetermined height dimension disposed about said ferrite circulator element and having plural spaced-apart input/output ports disposed there about;

at least one of said ports having at least a portion thereof with a reduced height dimension and spaced from said ferrite circulator element to thereby define a gap G with respect to said ferrite circulator element; and said gap G being dimensioned to achieve an approximate impedance match via said at least one port.

10. A waveguide circulator comprising: a ferrite circulator element including means for creating a magnetic field therein;

a conductive waveguide circulator cavity disposed about said ferrite circulator element and having plural input/output ports disposed thereabout;

at least one of said ports spaced from said ferrite circulator element to define a gap G with respect to said ferrite circulator element; and said gap G being dimensioned to achieve an approximately matched input/output impedance to/from said circulator via said port.

11. A waveguide circulator as in claim 10 further comprising:

ridge waveguide directly coupled to said at least one port.

12. A waveguide circulator as in claim 11 further comprising:

ridge waveguides directly coupled to at least two adjacent ones of said ports, each having a said gap G which is dimensioned for impedance matching via such couplings.

13. A waveguide circulator as in claim 10 having an H-field orientation and further comprising:

an adaptor means coupled to each of said ports for rotating E and H fields transmitted therethrough by approximately 90° to, in effect, produce an E-field orientation composite circulator apparatus.

14. A waveguide circulator as in claim 13 wherein said ferrite circulator element includes a latching wire loop located in a plane perpendicular to the E-field within said circulator to provide a latching circulator effectively having an H-field orientation.

* * * * *